United States Patent [19]

Wilson

[11] Patent Number: 5,056,277

[45] Date of Patent: Oct. 15, 1991

[54] PREFORMED CHIMNEY FLASHING

[76] Inventor: William P. Wilson, 100 Maple Dr., Orchard Park, N.Y. 14127

[21] Appl. No.: 604,228

[22] Filed: Oct. 29, 1990

[51] Int. Cl.[5] ..... E04D 1/36

[52] U.S. Cl. ..... 52/62; 52/60; 52/219

[58] Field of Search ..... 52/58, 60, 61, 244, 52/59, 62, 219

[56] References Cited

U.S. PATENT DOCUMENTS

| | | | |
|---|---|---|---|
| 1,699,181 | 5/1926 | Davison | 52/60 |
| 1,750,526 | 12/1927 | Knox | 52/61 |
| 1,782,246 | 11/1930 | Schneider | 52/61 |
| 2,417,039 | 1/1946 | Albaugh | 52/301 |

FOREIGN PATENT DOCUMENTS

| | | | |
|---|---|---|---|
| 1784294 | 7/1971 | Fed. Rep. of Germany | 52/61 |

*Primary Examiner*—Richard E. Chilcot, Jr.
*Assistant Examiner*—Wynn Wood
*Attorney, Agent, or Firm*—Richard C. Litman

[57] ABSTRACT

Preformed plastic chimney flashing includes a horizontal plate embedded in the mortar between two courses of bricks, and a lip extending downward from the outside edge of the plate. The plate, which extends across the full width of a brick, has holes for adhesion of mortar on either side of the plate. The lip is intended to cover ordinary metal flashing, which inserts between the lip and the brick wall. The lip includes a ridge on the lower inside edge to help seal against weather. The plastic is colored, weatherproof, and flexible. The flashing is preformed into several shapes adapted to cover runs, steps, corners, and cap bricks. No forming is required, only cutting to length for allow for some overlap.

9 Claims, 2 Drawing Sheets

PREFORMED CHIMNEY FLASHING

FIELD OF THE INVENTION

The present invention relates to chimney flashing.

DESCRIPTION OF THE PRIOR ART

Flashing is used to prevent rain water from seeping into a brick building. Flashing is used, for example, where two roof planes come together to form a gutter. The present invention relates to flashing used around chimneys which are built of brick or brick-like articles.

To form a waterproof seal along a course of bricks, flashing made of easily-bent sheet metal is often used. The sheet metal is typically aluminum or copper. The flashing metal is bent to form a narrow lip at right angles to the main part of the sheet. This lip is fastened into the brick work by inserting the lip into wet mortar between the courses; when the mortar sets hard the sheet metal lip is held to the brick wall. The flashing may be inserted during brick laying, or later. If later, the mortar will need to be removed from between two courses of brick.

Flashing on chimneys presents special problems because of the roof through which the chimney partially or fully protrudes. The chimney will meet the roof at an angle along two sides of the chimney; these angled sides present the problem.

Flashing must run around the chimney to prevent water from getting under the shingles or covering of the roof. Typically the flashing extends a short distance along the roof surface over the covering. At the angle of the roof and chimney the flashing bends up to a horizontal angle. It runs a short distance up along the bricks, and then the bent lip is inserted into the mortar between one brick and another.

This is not particularly troublesome on the non-angled sides, but along the angled sides it is very difficult to fit the metal flashing into the brickwork due to the many steps. As the roof rises, the flashing must jump from one course of brick to a higher or lower course. At each jump the flashing must be cut and bent to fit.

To fit many such steps requires cutting the flashing to the shape of the brick steps while including material for the lips. Depending on the pitch of the roof, the number of bricks between steps will vary; this complicates the pattern further. If a large sheet of metal is used, the pattern is complex; if small sheets are used, many joints will result, leading to an increased chance of leaks.

Despite the great work involved in setting metal flashing into a chimney, the results are often not good. Skill in both layout and cutting of sheet metal are needed. At corners and rises, the sheet metal will either overlap on the inside of a right angle bend (or else require two 45 degree cuts to prevent overlap there) or leave a gap on the outside of a right angle bend. The double thickness of an overlap may cause trouble in setting bricks of the two courses close enough. A gap, naturally, invites the water infiltration which the flashing is installed to prevent.

Even if the work is done properly, the results are often unsatisfactory because leaks can develop. Leaks result from differential thermal expansion of the metal and brick, dents to the metal, corrosion, etc.

Because of the drawbacks of custom-making the flashing, several persons have developed flashing systems which are prefabricated to some extent. Several patents relate to such prefabricated flashings for chimneys. U.S. Pat. No. 2,417,039 of Albaugh shows a metal or plastic sheath for a chimney top. This prevents water from damaging the top of the chimney. The sheath ends above the roof line.

A related U.S. Pat. No. is that of Miller U.S. Pat. No. 3,363,369). Miller teaches a vertically elongated metal shield surrounding a chimney which rises from the roof flashing up to a certain level. This shield is disposed beneath a flashing strip which runs around the chimney. The strip is basically an L-shaped piece which runs down over the shield to exclude water, and runs horizontally between bricks. The strip runs completely around the chimney to discourage leaks.

Both the Albaugh and the Miller inventions have the drawback of requiring customized sheet metal work. Also, the metal parts are subject to damage. Moreover, they may be considered unsightly because they cover brick with large sheet metal shields.

U.S. Pat. No. 1,782,246 of Schneider discloses prefabricated metal flashing in sections. The sections are of three types which fit together and overlap. The types are straight runs, right corners and left corners.

Schneider's flashing consists of the flashing proper, which is embedded in the mortar between brick courses and includes a downwardly extending lip, and the counterflashing which is inserted between the brick wall and the flashing lip. The counterflashing is thus removable. The flashing also includes a drip flange which extends from the surface of the brick above the lip and diverts rain water.

Schneider makes no provision for risers, that is, flashing which changes level from one course to another (steps). This means that the flashing will not closely follow a roof line in a typical chimney installation, where the chimney protrudes through a pitched roof, or through the ridge line of a roof. Thus the appearance of the chimney is affected, as with the two other prior art patents.

None of the above inventions and patents, taken either singly or in combination, is seen to describe the instant invention as claimed.

All of the above inventions utilize sheet metal, and their designs are predicated on this material. However, as noted above, sheet metal has several shortcomings. It corrodes in time, and requires paint to match the color of brickwork. The metal must be relatively thick and heavy to avoid bends and dents during shipment and construction, which would make the flashing unusable. The thickness means that the flashing may be strong enough to break itself loose from the mortar in which it is embedded, when temperature changes cause differential expansion.

Another drawback of metal for a system such as Schneider's is that sheet metal is hard to work in the field, where special equipment is lacking. Bending, sawing and cutting sheet metal are all awkward operations requiring somewhat specialized tools or fixtures. For example, if the metal is thin enough to be cut with metal shears, a bent piece is hard to cut around the bend; if it is thick enough to be hacksawed, it is again liable to bending unless very thick indeed.

Accordingly, one object of the present invention is flashing embedded between brick courses to which additional sheet counterflashing may be easily mated without mortar or adhesives.

Another object of the present invention is flashing which does not interfere with the firm adhesion of one course of bricks to another.

A further object of the present invention is flashing which is preformed to fit various brick configurations, so to avoid time-consuming cutting and bending.

Another object of the present invention is flashing which will not leave gaps or overlaps at corners.

An additional object of the present invention is flashing which requires no painting to match brick in color.

Still another object of the present invention is flashing which is not liable to damage by bending or crushing and which is easy to work.

A final object of the present invention is flashing which is easily cut to length with readily available tools.

These and other objects of the present invention will become readily apparent upon further review of the following specification and drawings.

SUMMARY OF THE INVENTION

The present invention is preformed plastic chimney flashing which runs along mortar joints between brick courses.

In cross section, the flashing includes a horizontal plate embedded in the mortar between two courses of bricks, and a lip extending downward from the outside edge of the plate. The plate, which extends across the full width of a brick, has holes for adhesion of mortar on either side of the plate. The lip is intended to cover ordinary metal flashing, which inserts between the lip and the brick wall.

The flashing is preformed into several shapes adapted to cover straight runs, steps, corners, and ridge cap bricks. No forming or bending is required at the construction site, only cutting to length for allow for some overlap.

The lip includes a ridge on the lower inside edge to help seal against weather.

The plastic is colored, weatherproof, flexible, and of such consistency that it may easily be cut with a knife.

BRIEF DESCRIPTION OF THE DRAWINGS

FIG. 3 shows the several special sections of the present invention.

Similar reference characters denote corresponding features consistently throughout the attached drawings.

DETAILED DESCRIPTION OF THE PREFERRED EMBODIMENT

Figure 1:
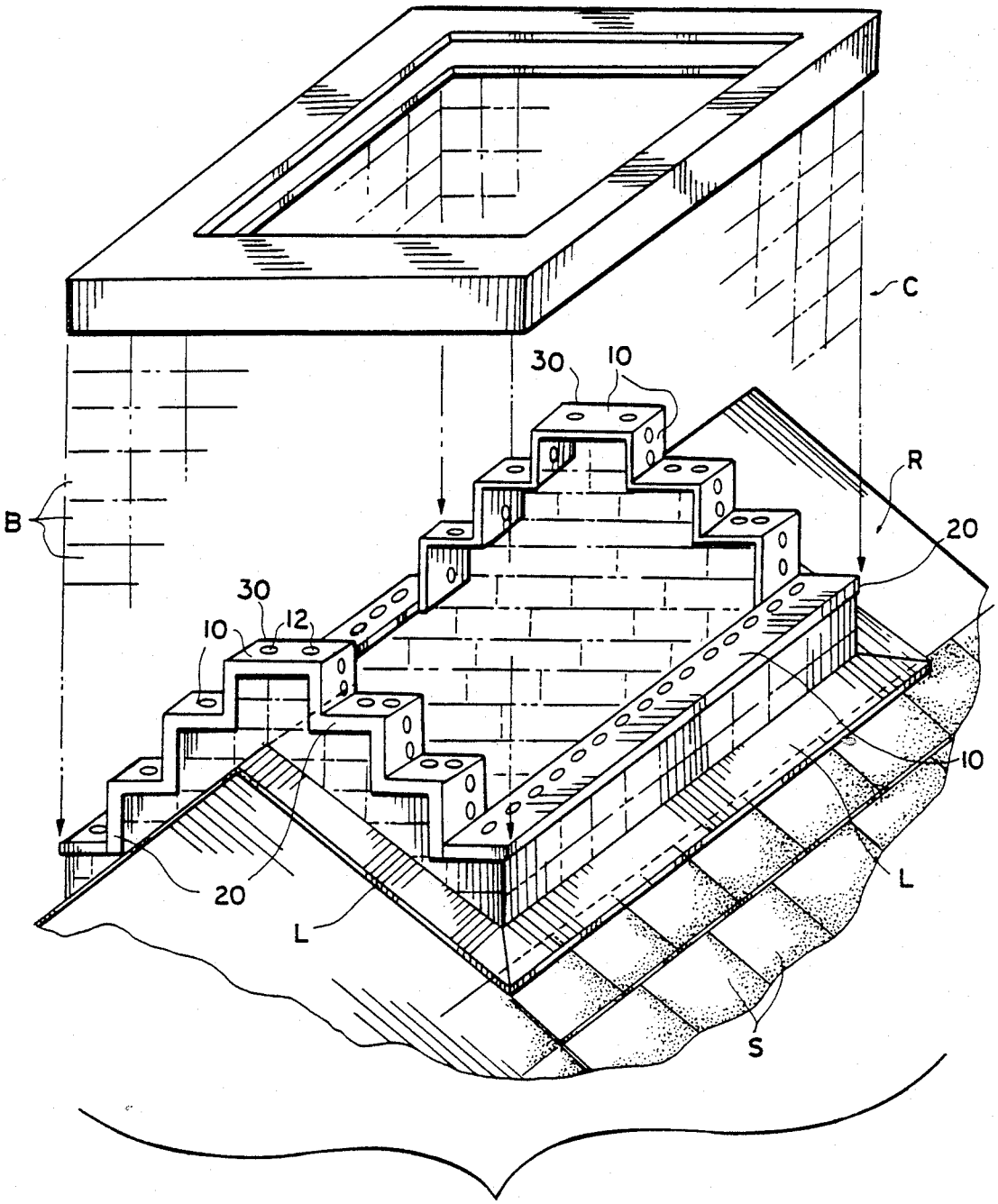
FIG. 1 is an environmental perspective view of the invention embedded in the brick work of a chimney. The environment is shown in phantom view. Metal flashing is shown inserted under the lip of the plastic flashing of the invention.

FIG. 1 shows an overview of the instant invention, flashing, in use. A chimney C, made of bricks B, protrudes through a roof R. Metal counterflashing L extends around the perimeter of the chimney C to prevent rain water from running under the shingles S covering the roof R. The metal flashing extends up the sides of the chimney C to the flashing of the instant invention.

Figure 2:
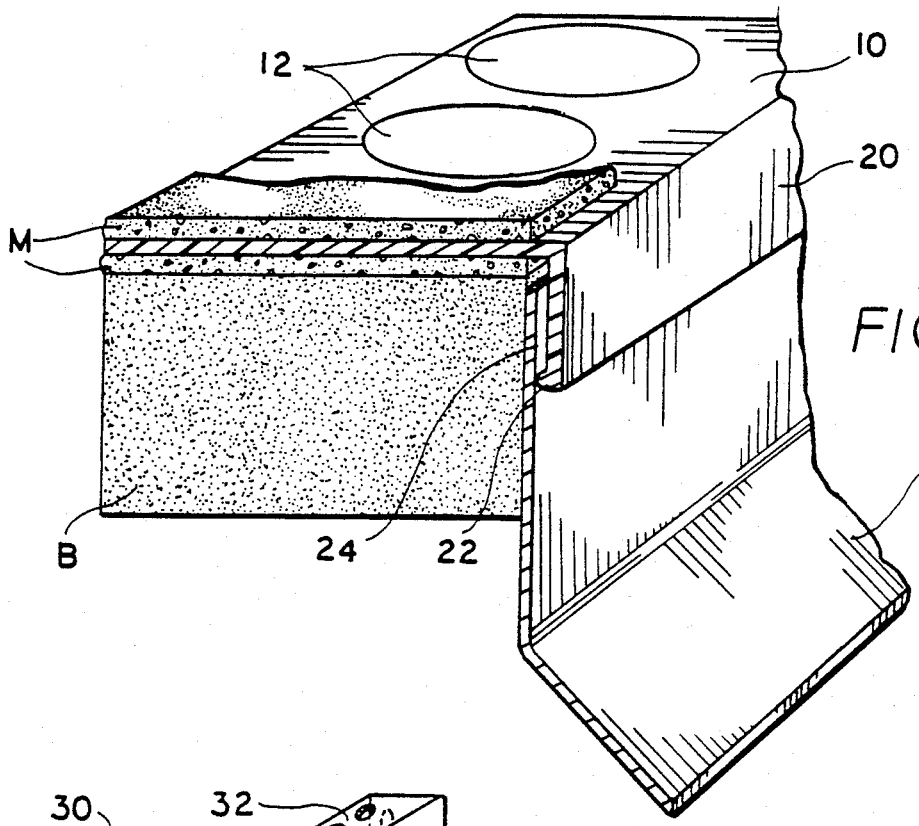
FIG. 2 is a perspective cross-sectional view of a brick wall with the plastic flashing of the invention embedded therein, showing the plate, lip, and the ridge at the bottom of the lip.

The flashing comprises two main parts, a plate 10 and a lip 20. These parts are also shown in FIG. 2.

The plate 10 is disposed between two neighboring bricks. These two bricks may lie side by side, or above and below one another; the plate 10 may be horizontal or vertical. The plate is set into the mortar M (which cements the adjacent bricks) during brick laying. Holes 12 in the plate 10 allow the mortar adhering to adjacent bricks to penetrate the plate 10, so that adjacent bricks are cemented together by continuous mortar. Because of these holes 12, the plate 10 may have a width equal to the depth of one brick B, and so extend completely across one course of the brick work. The plate 10 will then be firmly held.

The plate 10 runs in an unbroken path around the chimney C, close to the roof R.

The lip 20, which is about half an inch wide, extends downward or sideways from the plate 10. The lip 20 covers the upper edge of the counterflashing L to prevent rain water from running between the counterflashing L and the chimney C or roof R.

The flashing is preferably molded of relatively soft plastic, which has several advantages over the usual metal flashing. Plastic will not dent; it is easily cut and does not leave sharp dangerous edges; it may be colored to match the brick, or to have a pleasant contrasting color; it need not be painted periodically by climbing onto a roof top; and having a lower elastic modulus than metal, it is less likely to break loose from the mortar M by differential temperature expansion.

The ideal plastic material would be flexible even at low temperatures; easily cut with a carpet knife, shears, or the like; resistant to weather and sunlight; and inexpensive.

The use of molded plastic makes possible a major advantage of the present invention, that the flashing surfaces are continuous.

(In this specification and in the following claims, the word "continuous" means without gaps, openings, seams, joints, fasteners, or overlaps. The word "continuous" does not, however, exclude bends, curves, edges, or angles. "Continuous in the region of" a thing means that no gaps, openings, seams, joints, fasteners, or overlaps exist very near to or adjacent to that thing; or, the structure is continuous in that region. Also, if one region or structure is said to be continuous with another, it means that no obstructions as listed above separate those two regions.

Thus, continuity as defined herein means that from any point within the material of the structure (here, plastic), one could reach any other nearby point within the structure in the specified region by traveling through the material of the structure and never having to leave that structural material to pass through another material (e.g., air or adhesive).

This specification's definition of continuity is essentially the same as the mathematical definition of the word, especially the topological definition.)

Since the molded flashing surfaces are continuous in the present invention, there is no danger of leakage between adjacent sections of flashing as there is with sheet metal flashing. Sheet metal flashing cannot be made continuous in the regions of the brick corners. To cover the same brick surface areas as the molded plastic flashing of the present invention, sheet metal must have overlapped lips at acute bends, and must have additional pieces to cover the corner gaps left in the lips at an obtuse bend. Sheet metal flashing lips would, in addition, need to be soldered to have the same water-impervious character as the continuous molded plastic lips of the present invention. Soldering would of course be very unlikely in view of the great work involved.

Another feature of the instant invention, shown in FIG. 2, would also be impossible with sheet metal. This is the ridge 22, which comprises a thickened portion of the lip 20. The ridge 22 allows the lower edge of the lip 20 to closely seal the counterflashing L against water, while allowing the counterflashing L to be easily inserted and pulled from the slot space 24 defined by the outer surface of the brick B and inside surface of the lip 20.

The flashing may be contoured to remain at a small distance above the roof line. The counterflashing L need only rise a bit more than the height of one brick above the roof R, unless the roof pitch is quite steep. Thus the visual impact of the flashing is minimal. If the plastic of the flashing is colored to match the bricks B, the flashing will be almost invisible.

If many identical houses are to be erected, the entire flashing can be molded as one unit. This situation is unlikely, though. To accommodate the flashing to the demands of custom design, it may be made in prefabricated sections.

Such sections will need to be joined in some way. To avoid the need for fasteners and glue, they may be simply overlapped. The overlaps, to avoid leakage, should run vertically across horizontally-extending sections of the lip 20. The amount of overlap might be about a half-inch.

Figure 3A:
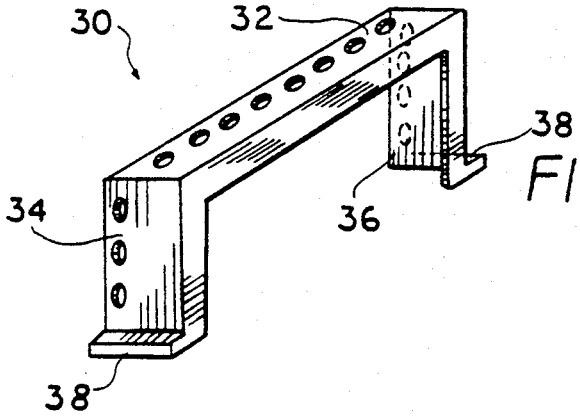
FIG. 3*a* shows a ridge cap for a single brick.
Figure 3B:
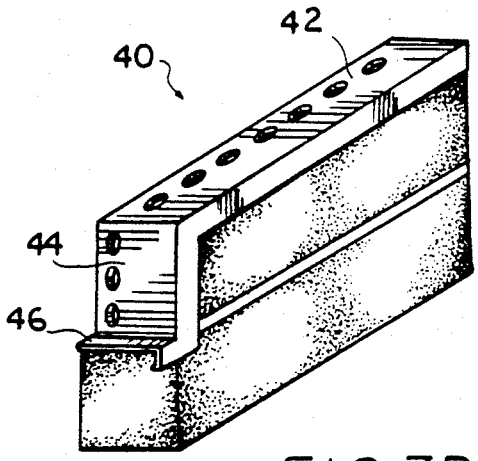
FIG. 3*b* shows a riser.
Figure 3C:
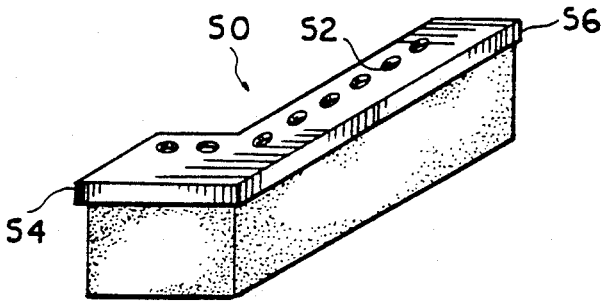
FIG. 3*c* shows a corner piece.

The preferred set of sections are partially shown in FIGS. 3*a*–3*c*. Not shown in FIGS. 3*a*–3*c* is a simple straight section; this section will be clear to the reader from the other figures.

FIG. 3*a* shows a cap section 30. This section is set upon the uppermost brick in a region, for example, at the ridge line of the roof R. FIG. 1 also shows the position of a cap section 30.

The cap section 30 includes an upper horizontal plate 32, left and right side plates 34 and 36, and short lower plates 38. (As with all the sections, the lips attached to the various plates are contiguous, and, due to the molded construction, continuous.) The lower plates 38 provide for overlap with the adjacent sections on either side, which could be a straight section or another type as discussed below.

A riser section 40 is shown in FIG. 3*b*. This comprises an upper plate 42, lower plate 46, and a side plate 44 joining them. To fit all installations, the riser section will come in two varieties, the one pictured and another which is similar to the one shown but mirror reversed.

(If an object is said in this specification or claims to be "mirror reversed", it means that a new object is generated which is identical in appearance to the mirror image of the old object.)

The riser sections which are mirror images of one another can be denoted "left-hand" and "right-hand" sections, but these designations are totally arbitrary, since there is no connection between either one and the human hand. These phrases are nevertheless useful and commonly used for distinguishing mirror image items, such as shoes.

A corner section 50 is shown in FIG. 3*c*. Here there is a plate 52 lying in a single plane (but not rectangular), and two lips 54 and 56 which are mutually perpendicular. Here again, another section is generating by mirror reversing the corner section pictured.

As shown, the corner section may be arranged to cover one brick by extending across and along a brick horizontally.

Thus a total of six sections will cover any situation. Alternatively, the cap section could be replaced by two mirror-image riser sections.

It is to be understood that the present invention is not limited to the sole embodiment described above, but encompasses any and all embodiments within the scope of the following claims.

In particular, "brick" herein means any brick-like object used in making chimneys, walls or the like.

Also, the present invention is clearly not restricted to chimneys. Any brick wall near a roof, or any brick wall in need of flashing, may use the present invention.

I claim:

1. Flashing for a vertical wall constructed of bricks and mortar and having an exterior surface, said flashing comprising:

a generally flat horizontal plate of essentially constant plate width, said horizontal plate having an outside edge adjacent said exterior surface, said horizontal plate disposed between two adjacent bricks;

holes in said horizontal plate for admitting therethrough said mortar; and a generally flat lip of essentially constant lip width joined to said horizontal plate along said outside edge, said lip extending from said outside edge generally parallel to said exterior surface, said lip adjacent said outside edge, said horizontal plate and said lip continuous;

said bricks having corners, and said horizontal plate and said lip continuous in a region of any one of said corners;

said lip including a ridge area, said ridge area thicker than areas of said lip adjacent said ridge area, said ridge area protruding from a side of said lip adjacent said exterior surface, and said ridge area distal said outside edge on said lip; whereby a slot space is created between said exterior surface.

2. Flashing as in claim 1, wherein said horizontal plate width is generally equal to the depth, normal to said exterior surface, of one of said bricks.

3. A straight section of flashing as in claim 1, wherein said horizontal plate is a single planar element, and said lip is a single planar element.

4. Sections of flashing as in claim 1, further comprising a left handed riser, said left handed riser including a lower section of said horizontal plate, a vertical plate joined to said lower section of said horizontal plate along a lower edge, and an upper section of said horizontal plate joined to said vertical plate along an upper edge, said lower section of said horizontal plate disposed to the left of said upper section of said horizontal plate as seen from outside of said exterior surface.

5. Sections of flashing as in claim 1, further comprising a right handed riser, said right handed riser including a lower section of said horizontal plate, a vertical plate joined to said lower section of said horizontal plate along a lower edge, and an upper section of said horizontal plate joined to said vertical plate along an upper edge, said lower section of said horizontal plate disposed to the right of said upper section of said horizontal plate as seen from outside of said exterior surface.

6. A cap section of flashing for a vertical brick wall having bricks and mortar, said wall having an exterior surface, said flashing comprising a flat plate, said plate having an outside edge adjacent said exterior surface, said plate disposed between two adjacent bricks, and having an essentially constant plate width, holes in said plate for admitting therethrough said mortar, and a generally flat lip joined to said plate along said outside edge, said lip having an essentially constant lip width, said lip extending from said outside edge generally parallel to said exterior surface, said plate and said lip continuous;

said bricks having corners, and said plate and said lip continuous in the region of any one of said corners;

said cap section including an upper horizontal section of said horizontal plate, a left hand vertical plate joined to said upper horizontal section of said horizontal plate along an upper left hand edge, a right hand vertical plate joined to said upper horizontal section of said horizontal plate along an upper right hand edge, a left hand horizontal section of said horizontal plate joined to said left hand vertical plate along a lower left hand edge, and a right hand horizontal section of said horizontal plate joined to said right hand vertical plate along a lower right hand edge.

7. Sections of flashing as in claim 1, further comprising a corner wherein said horizontal plate lies in a single plane, and including a first area of said lip and a second area of said lip, said first area and said second area mutually perpendicular.

8. A corner as in claim 7, wherein said first area extends a first distance generally equal to the horizontal thickness of one of said bricks, and said second area extends a second distance generally equal to the horizontal length of one of said bricks.

9. A corner as in claim 8, wherein the corner is mirror reversed.

* * * * *